United States Patent [19]

Henze et al.

[11] Patent Number: 4,941,418

[45] Date of Patent: Jul. 17, 1990

[54] SEWING INSTALLATION FOR FABRIC ARTICLES

[75] Inventors: Siegfried Henze, Saal/Saale; Hans Ziegler, Grossbardorf; Martin Schnaus, Bad Königshofen, all of Fed. Rep. of Germany

[73] Assignee: Texpa Arbter Maschinenbau GmbH, Fed. Rep. of Germany

[21] Appl. No.: 267,331

[22] Filed: Nov. 4, 1988

[30] Foreign Application Priority Data

Nov. 4, 1987 [DE] Fed. Rep. of Germany ..... 3737369

[51] Int. Cl.[5] ..... D05B 27/12

[52] U.S. Cl. ..... 112/304; 112/121.12

[58] Field of Search ..... 112/10, 113, 121.11, 112/121.12, 272, 303, 304, 311, 320; 198/463.2, 468.01, 468.2, 575, 576; 271/264, 265

[56] References Cited

U.S. PATENT DOCUMENTS

| | | | |
|---|---|---|---|
| 3,204,590 | 9/1965 | Rockerath et al. | 112/304 X |
| 3,461,825 | 8/1969 | Brown | 112/10 |
| 3,496,891 | 2/1970 | Kosrow et al. | 112/304 X |
| 3,782,305 | 1/1974 | Robinette | 112/10 |
| 4,236,472 | 12/1980 | Rockerath et al. | 112/304 |
| 4,607,582 | 8/1986 | Brocklehurst | 112/121.12 |

*Primary Examiner*—Werner H. Schroeder
*Assistant Examiner*—David K. Suto
*Attorney, Agent, or Firm*—Frank P. Presta

[57] ABSTRACT

A sewing installation for fabric articles, comprising a first material handling device which transfers the fabric articles from a stockpile to a second material handling device having endless conveyor belts. A lifting device is provided for raising the conveyor belts for the introduction of the fabric articles over a portion of their length and for lowering the conveyor belts for the pick-up and further conveyance of the fabric articles to at least one sewing machine. The lifting device comprises movable lifting elements which engage from below in turn on the bottom drums of the conveyor belts. The lifting elements are arranged so taht they can be moved back and forth substantially parallel to the conveyor belts and can be driven in the direction of conveyance when in a raised state and in the opposite direction when in a lowered state. Scanning elements, which detect the ends and the beginnings of fabric articles in series, control the lifting and lowering movement of the conveyor belts as well as the lifting and lowering movement and the back and forth movement of the lifting elements. The conveyor belts of the second material handling device are constructed to circulate continuously in the raised and lowered state.

8 Claims, 7 Drawing Sheets

SEWING INSTALLATION FOR FABRIC ARTICLES

BACKGROUND OF THE INVENTION

The invention relates to a sewing installation for fabric articles, for instance bedclothes of all sorts, including fitted sheets, sponge fabric articles, wool blankets and so forth, which are to be provided with a seam and/or rubber or elastic tapes, binding or border strips, trimming, braid or the like, with a first material handling device for the fabric articles cut to length from a stock, which transfers these fabric articles to a second material handling device including endless conveyor belts, which can be raised by a lifting device for the introduction of the fabric articles over a part of their length and can be lowered in order to pick up and further convey 15 the fabric articles, to at least one sewing machine, and the lifting device has lifting elements which engage from below in turn on the bottom drum of the conveyor belts.

In a known sewing machine of this type, the second material handling device has two endless conveyor belts at some spacing from each other and side by side, between which can be introduced the first material handling device, in order to transfer the fabric articles to the second material handling device. During the introduction phase of the fabric articles by the first material handling device to the second material handling device, the second material handling device is raised by a lifting device, and simultaneously the power for the second material handling device and also the sewing machine is disconnected, and indeed remains disconnected until the conveyor belts of the second material handling device are once again lowered, in order to pick up the subsequent fabric article which is being fed in and to transport it further to the sewing machines. In this known installation a sewing machine is arranged at each longitudinal side of the second material handling device, in order to process the fabric article by working on two opposite edges. Because of the aforementioned intermittent method of processing, the fabric article can be processed only in steps in the second material handling device together with the sewing machines, which correspondingly reduces the sewing rate, and rate of production of these known sewing machines. Also, because of the intermittent processing of the of the sewing machines, a number of flaws occur, including thread breakages. Another drawback of this known sewing machine resides in that the lifting elements engaging in turn from below on the bottom drum of the two conveyor belts are fixed rigidly on the machine frame and therefore extend over the entire width of the fabric articles. If these are changed, the position of the lifting elements is then reversed on the machine frame, which is complicated, bothersome, and time-consuming.

SUMMARY OF THE INVENTION

The object of the invention is to provide a continuously and securely operational sewing machine with a correspondingly high sewing rate and rate of production, in which the lifting elements engaging from the bottom in turn on the bottom drum of the conveyor belts are automatically adjusted to changing fabric article dimensions.

According to the invention the above object is attained in that:

(a) the lifting elements are arranged substantially parallel to the conveyor belts of the second material handling device where they can be moved back and forth, and are driven in the direction of conveyance when in a raised state and in the opposite direction when in a lowered state;

(b) the lifting and lowering movement of the conveyor belts of the second material handling device as well as the lifting and lowering movement and the back and forth movements of the lifting elements are controlled by following scanning elements, which detect the ends and the beginnings of fabric articles which are following one another in series; and (c) the conveyor belts of the second material device run in the raised and lowered state without interruption.

While the conveyor belts of the second material handling device are in a raised state over a portion of their length, then, without interruption of the further material handling of a fabric article by its conveyance through the second material handling device and the sewing procedures in the sewing machines, a new fabric article can advantageously be introduced by the first material handling device beneath the raised up conveyor belts of the second material handling device. The conveyor belts of the second material handling device are lowered following this introduction, in order to pick up the new fabric article and to transport it further along to the sewing machines, while at the same time the first material handling device turns back into its original position, in order to pick up another fabric article and to move it in the direction of the second material handling device. Fabric articles are fed continuously to sewing machines in this manner and there they are treated, to attain an extremely high sewing rate and high production rate.

The lifting and lowering movement of the conveyor belts of the second material handling device is controlled by following scanning elements, which detect the ends and the beginnings of fabric articles which are in series one following the other and thus simultaneously also control the lifting and lowering movement as well as the back and forth movement of the lifting elements engaging from below on the bottom drum of the conveyor belts of the second material handling device. When the conveyor belts of the second material handling device are lowered once again and convey the next fabric article in the direction of the sewing machines, then the lifting elements in a lowered state are moved back again into their original positions and a new detection and pick-up procedure can begin, which is initiated with the detection by a scanning element of the end of the last fabric article in series one after the other run back and forth with the lifting elements. A shift occurs automatically for adaptation to changing dimensions (widths) of the fabric articles.

Different configurations of the invention are disclosed and claimed herein. In these the high rate of production of the sewing machine can be raised further when the material handling speed of the first material handling device is adjusted to be higher over the major portion of its material handling segment than the speed of the second material handling device and not until shortly before the lowering of the second material handling device for the purpose of picking up another fabric article is the material handling speed brought into conformity with the other. The second material handling device can also therefore be operated at relatively high work speed.

A further configuration of the invention is characterized in that the lifting elements are driven in the direction of transport of the second material handling device synchronously with their material handling or conveyance speed, which is to be adapted to the work speed of the sewing machine(s), then a high degree of security is attained in the transfer of a fabric article from the first material handling device to the second material handling device.

When the sewing installation is provided with a plurality of back-up rollers engaging on the bottom drum of the conveyor belts of the second material handling device, and the rollers can be raised with the conveyor belts and, when in lowered position the conveyor belts hold the fabric articles against the supporting plates of the sewing installation, then according to still another feature of the invention, the back-up rollers can be raised within the range of movement of the lifting elements when they come into proximity with each other during movement in the direction of conveyance, for instance by means of separate lifting cylinders. These back-up rollers are therefore raised only when the lifting elements for the bottom drums of the conveyor belts come into proximity with one another, and their proximity can be controlled for instance by a mechanical or photoelectric control mechanism. As a result of this measure the further handling or conveyance of the fabric articles in the direction of the sewing machines is then still guaranteed without any problem, if already a great portion of the conveyor belts is raised, in order to facilitate the introduction of a new fabric through the first material handling device.

An exact separation between the raised and thus inoperative segment and the still lowered and thus operative segment of the bottom drum of any one of the conveyor belts is obtained by means of the back-up rollers as disclosed herein, which takes effect advantageously during the operation of the second material handling device.

According to still another configuration of the invention a holder is arranged projecting upwardly on the sliding carriage for the scanning elements which are controlling the lifting device.

BRIEF DESCRIPTION OF THE DRAWINGS

The invention is explained in greater detail hereinafter relative to the drawings of one exemplary embodiment. In the drawings.

DESCRIPTION OF THE PREFERRED EMBODIMENTS

Figure 1:
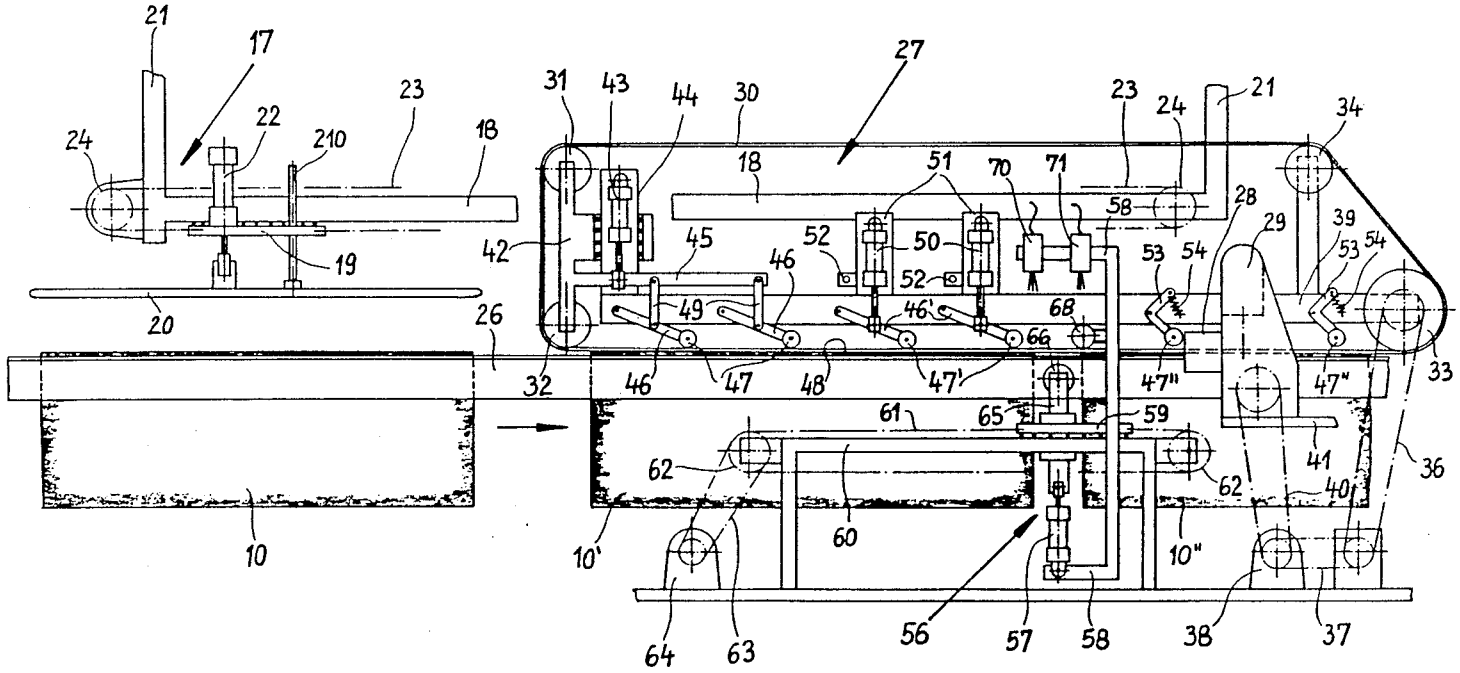
FIG. 1 is a diagrammatic side elevational view of the sewing installation according to the invention with the first and second material handling device, in which the second material handling device is shown in a lowered state, arranged to handle two fabric articles which are in series, one following the other.
Figure 2:
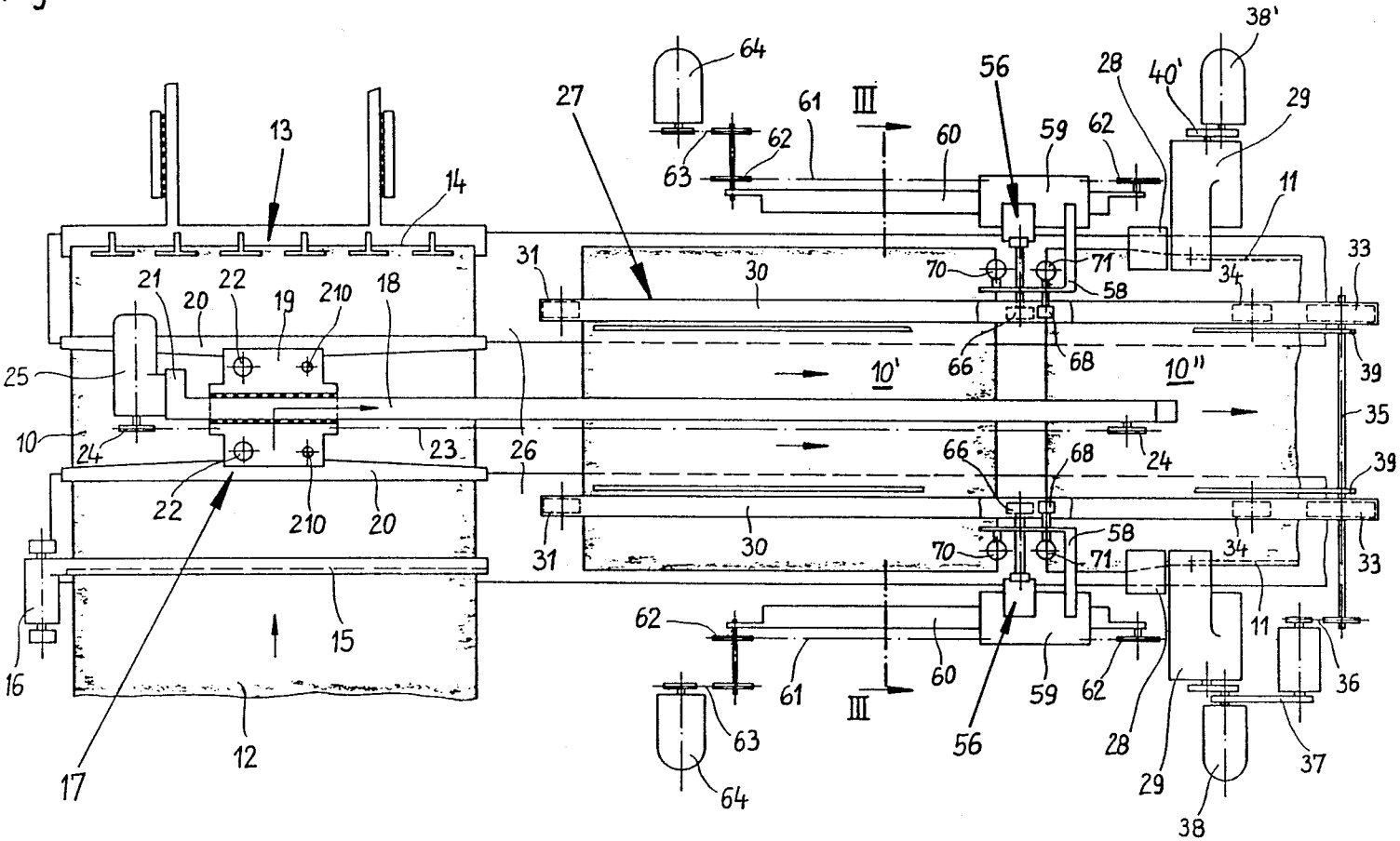
FIG. 2 is a plan view of the portions of the sewing installation shown in FIG. 1, but in this case without the lifting device for the conveyor belts of the second material handling device and without the back-up rollers for the bottom drum of the conveyor belts.
Figure 3:
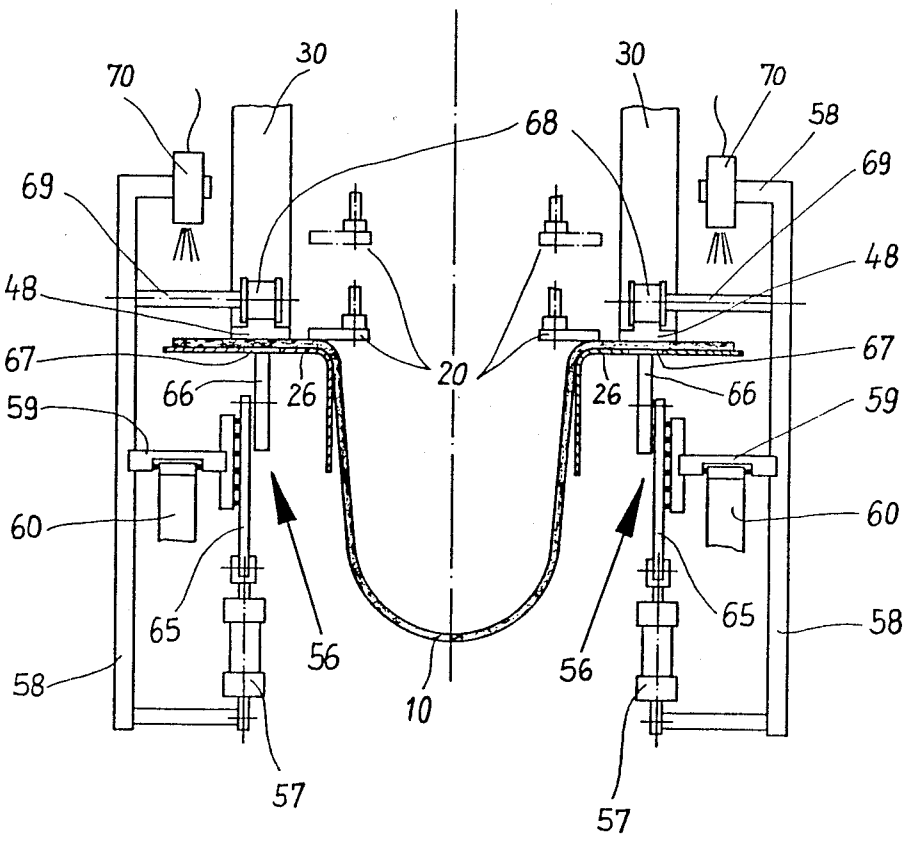
FIG. 3 is an enlarged diagrammatic cross sectional view taken along the line III—III of FIG. 2.

In the exemplary embodiment of a sewing installation shown in FIGS. 1–7, fabric articles 10, 10', 10'' and so on are to be provided with, for instance, a seal 11 on each of their opposite edges. Rubber strips could also be sewn into this seal 11, for instance, in order to produce fitted sheets. An uncut piece of fabric 12 serves as starting material for the fabric articles 10, 10', 10'' and so forth, and uncut piece of fabric 12 is drawn from a stockpile or a stock roll by means of the gripping mechanism 13. Gripping mechanism 13 is an assembly which is known for this type of sewing installation, which therefore need not be further explained. Gripping device 13 picks up the uncut piece of fabric 12 at one cutting edge 14 and draws a desired length in the direction of the arrow, whereupon a motor-powered cutting blade 15 is set in operation, in order to section off one separate fabric 10. Separated article 10 is folded in the middle by a folding device (not shown), as indicated in FIG. 3. In this state article 10 is picked up by the first material handling device 17 to be conveyed in the direction of the arrow.

First material handling device 17 has a sliding carriage 19 mounted on a guide bar 18, which supports two entrainment bars 20. Guide bar 18 is fastened to parts 21 of the machine frame parallel to the direction of material handling and conveyance of fabric articles 10, 10' and so forth. Entrainment bars 20 are fastened separately and individually each to two guide bars 210 and the piston rods of two lifting cylinders 22. These cylinders are then fastened to sliding carriage 19, while guide bars 210 are mounted to be able to slide vertically relative to sliding carriage 19. Also, both ends of a chain 23 are fastened to sliding carriage 19, and said chain runs over two chain drives 24, of which the left chain drive 24 as shown in FIGS. 1 and 2 is driven by a motor 25 in either direction as desired. The right chain drive 24 is mounted universably rotatable on guide bar 18. Motor 25 is fastened to a part 21 of the machine frame.

Entrainment bars 20 have a friction lining (not shown) on their bottoms and by means of said linings for the conveyance of fabric articles 10, 10' and so forth in the direction of the arrow they are brought in turn into engagement with each article, and indeed on the two opposite edge areas of fabric articles 10, 10' and so forth, which engage on the bent down supporting plate 26 (FIG. 3). Both supporting plates 26 are fastened at some spacing from each other side by side and parallel to the direction of conveyance of fabric articles 10, 10' on the machine frame.

The two entrainment bars 20 are shown in FIG. 1 in their raised position and are shown in FIG. 3 in broken lines in their raised and inoperative position and in full lines in their work position, in which, with corresponding movement of sliding carriage 19 to the right as shown in FIGS. 1 and 2, they introduce the relevant fabric article 10, 10' and so forth in the direction of the arrow to a second material handling device 27, at the two sides of which are arranged, in mirror image, a folding device 28 and a sewing machine 29. Folding devices 28 are indicated only diagrammatically and serve for the formation of the seams 11, while the sewing machines 29 stitch the seams 11.

The second material handling device 27 has two endless conveyor belts 30, which are guided over rollers 31–34. Rollers 33 form the drive rollers for conveyor belts 30 and are fastened for this purpose on a shaft 35, which is driven over endless chains 36, 37 by a motor 38. Shaft 35 is mounted to be rotatably movable in two parts 39 of the machine frame. Motor 38 also drives the one sewing machine 29 by means of another endless chain 40, while the other sewing machine is powered by its own separate motor 38' over another endless chain 40'. Motors 38, 38' and with them sewing machines 29 work synchronously. Sewing machines 29 are in turn fastened to brackets 41 of the machine frame.

Figure 4:
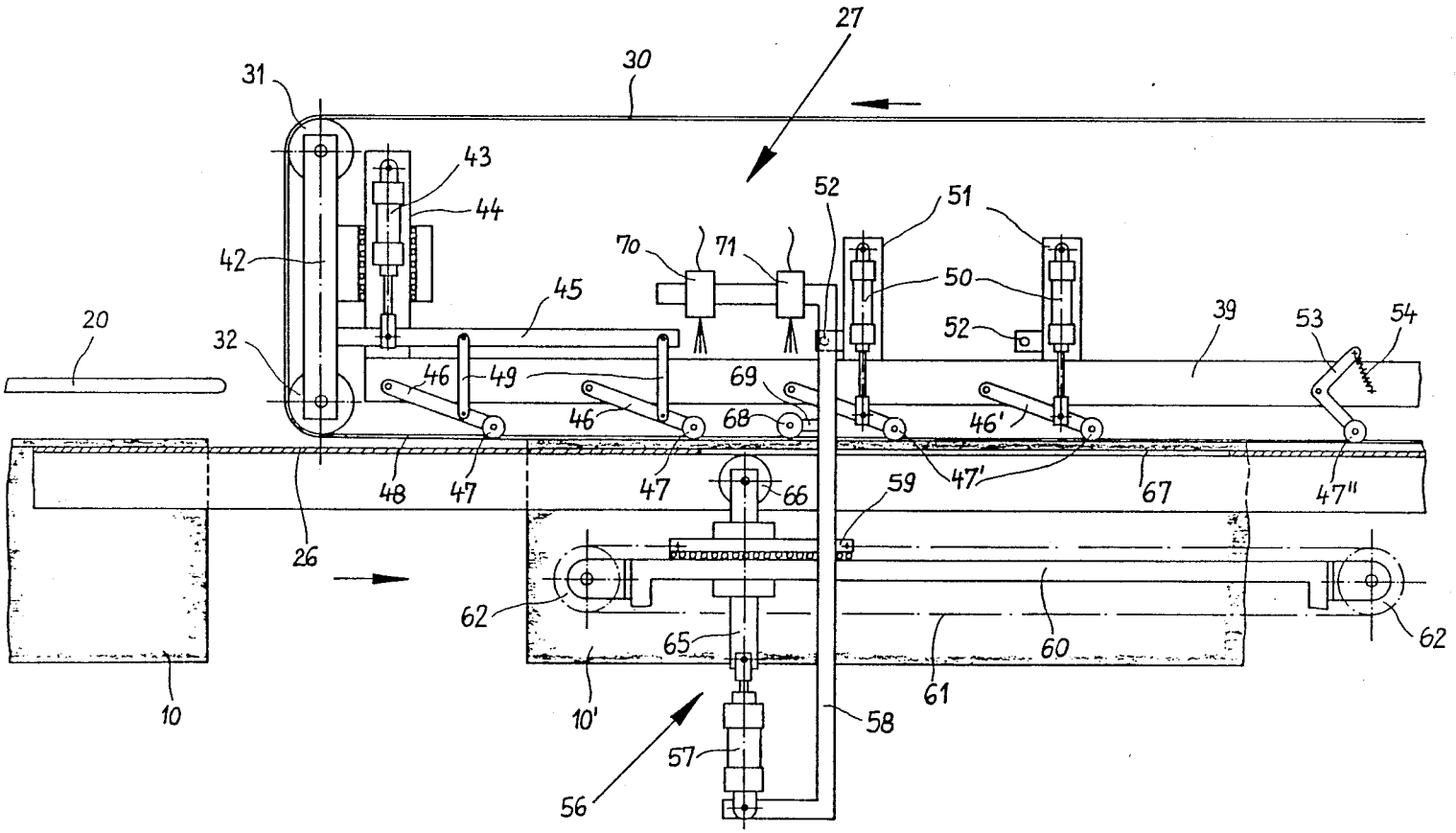
FIG. 4 is a partial side elevational view of the second material handling device in a completely lowered status.
Figure 5:
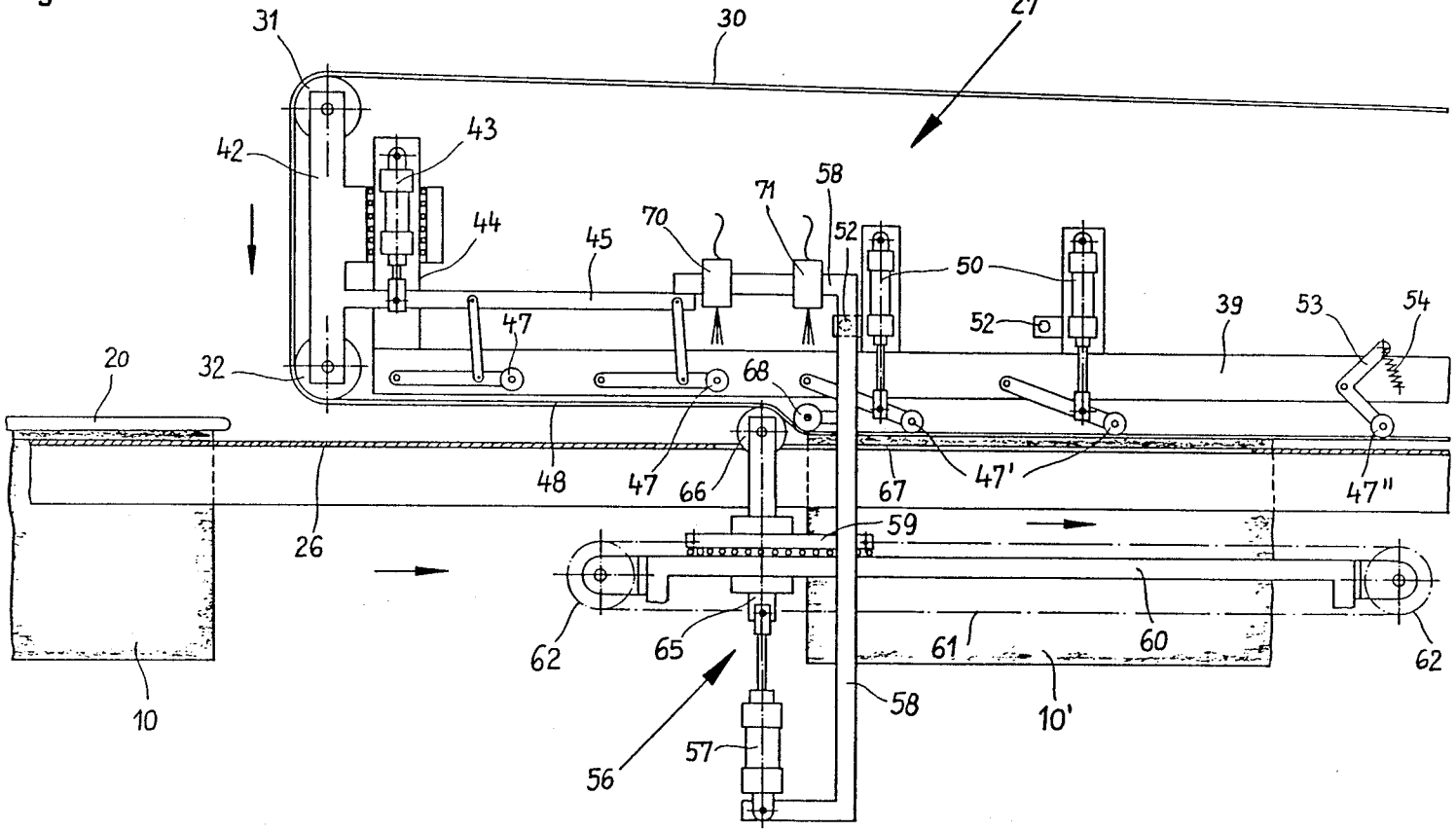
FIG. 5 is a partial side elevational view similar to that of FIG. 4, but in this case with partially raised conveyor belts.
Figure 6:
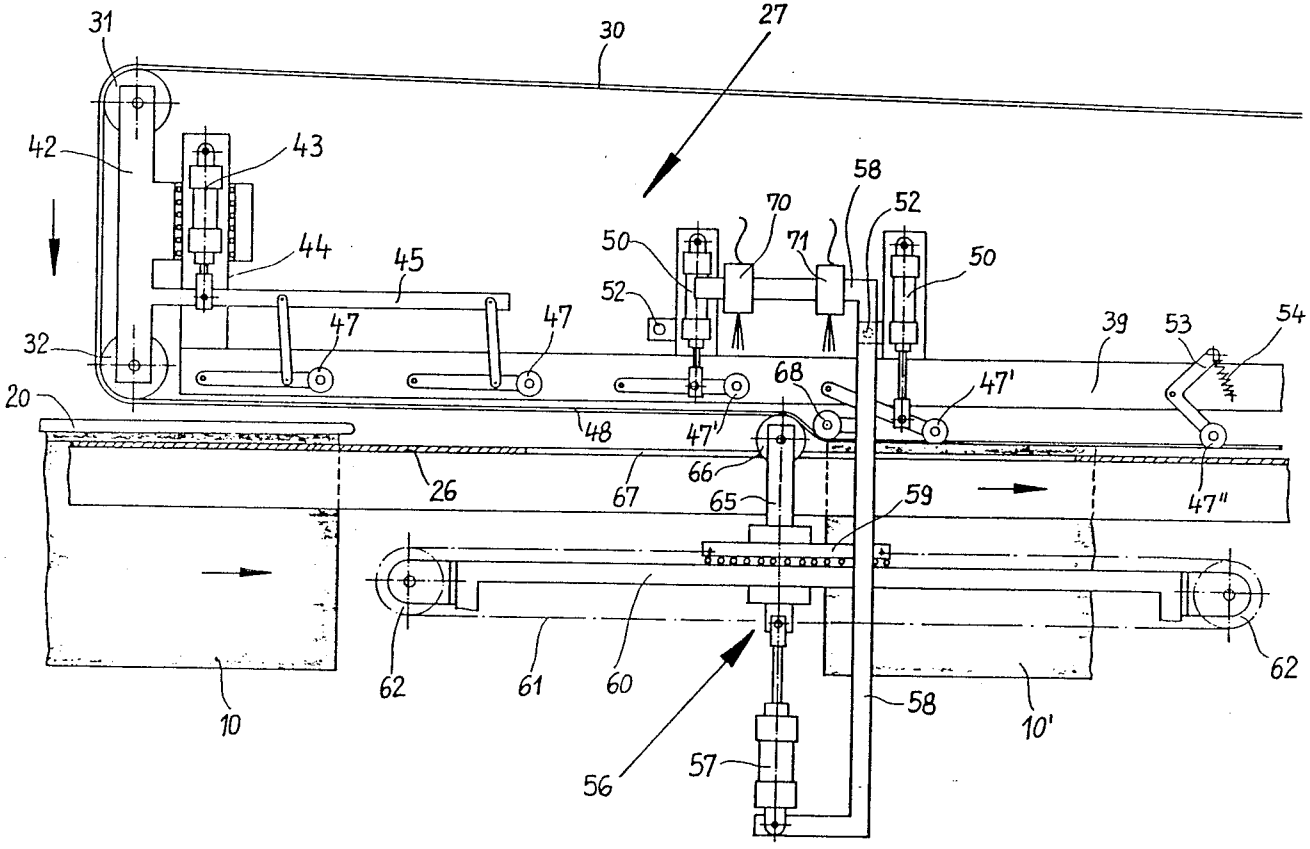
FIG. 6 is a partial side elevational view similar to those of FIG. 4 and 5, in which the conveyor belts are raised along a still greater length, in which the fabric article which is the next article to be introduced through the first material handling device is shown to be already partially under the conveyor belts of the second material handling device.
Figure 7:
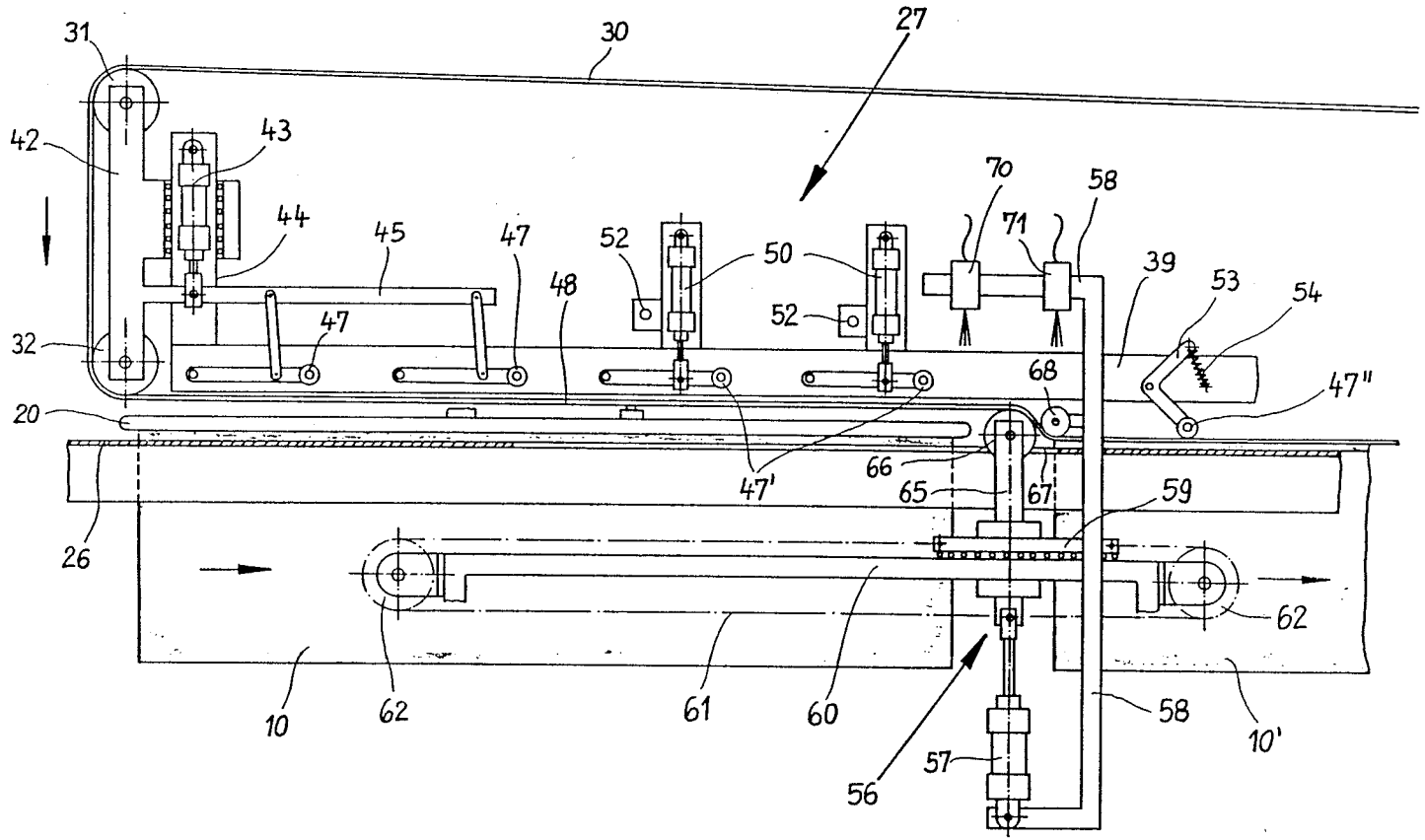
FIG. 7 is a partial side elevational view similar to those of FIGS. 4–6 of the second material handling device with conveyor belts raised up over a considerable segment of the length and a following fabric article being introduced under these belts from the first material handling device, shortly before the lowering of the conveyor belts on this fabric article.

As is particularly clear in FIG. 3, entrainment bars 20 of first material handling device 17 are arranged so that they can be moved into the space between the two conveyor belts 30 of second material handling device 27, in order to bring fabric article 10 into a pick-up position for second material handling device 27, as shown in FIG. 7. For the purpose of picking up fabric article 10, second material handling device 27 can be raised by a lifting device over a large portion of its length, as is shown in FIG. 7. This lifting device comprises one sliding carriage 42 associated with each conveyor belt 30, which can be moved upward and downward by means of a lifting cylinder 43. Lifting cylinders 43 are fastened with their top ends each to a guide bar 44, on which sliding carriages 42 are also mounted to be able to slide vertically. Piston rods of lifting cylinders 43 are in turn articulated on a horizontal arm 45 connected with sliding carriage 42. Sliding carriages 42 also support the universally rotating rollers 31 and 32 for conveyor belts 30. The two vertical guide bars 44 are fastened to parts 39 of the machine frame, to which are also articulated bearing brackets 46 of back-up rollers 47. These back-up rollers 47 engage on the inside of bottom drum 48 of conveyor belts 30 and press this bottom drum 48 against fabric article 10, 10' and so forth on supporting plates 26, when the second material handling device 27 is found in the lowered state, which is shown in FIGS. 1 and 4. Bearing brackets 46 of back-up rollers 47 are articulated on connectors 49, which are then mounted rotary movably on horizontal arm 45 of sliding carriage 42. As a result of these measures with the raising of the two sliding carriages 42 by means of lifting cylinder 43 the back-up rollers 47 are also lifted at the same time, as is shown in FIGS. 5–7.

Further back-up rollers 47' and 47'' are indicated for bottom drums 48 of conveyor belts 30. Bearing brackets 46' of back-up rollers 47' are likewise articulated on parts 39 of the machine frame, and also connected by articulation with the piston rods of lifting cylinders 50. Lifting cylinders 50 are fixed with their top ends on uprights 51, which in turn are fastened to parts 39 of the machine frame. Lifting cylinders 50 can be used for the lifting of back-up rollers 47' one after the other over electric limit switch 52. The operation of limit switch 52 is to be explained hereinafter. It is to be noted that lifting cylinders 50 for back-up rollers 47' are located on each conveyor belt 30.

Back-up rollers 47'' are mounted on toggle levers 53, which are prebiased by tension springs 54, which draw and/or respectively hold down back-up rollers 47'' fixed against bottom drum 48 of conveyor belts 30. In the area of each sewing machine 29 then conveyor belts 30 with their bottom drums 48 are held perpetually against fabric articles 10, 10' and so forth, when the articles are found on supporting plates 26. At this point it is to be noted that supporting plates 26 extend over the entire area of the first and second material handling device 17 or respectively 27. It is also to be noted and emphasized that in accordance with the length of second material handling device 27, it is also conceivable to provide more than six back-up rollers 47, 47', 47'' per conveyor belt 30. These six back-up rollers are thus shown only as an example of embodiment in FIG. 1.

As aforementioned, back-up rollers 47'' hold conveyor belts 30 in the area of sewing machines 29 uniformly against a fabric article 10, 10' and so forth on supporting plates 26. So that now with raising of conveyor belts 30 for the purpose of picking up a fabric article 10, 10' and so forth by the second material handling device 27 of which the bottom drums 48 are brought to a sufficient distance from supporting plates 27 to facilitate a satisfactory introduction of the next fabric article 10 by means of entrainment bars 20 of first material handling device 17, the lifting device for conveyor belts 30 has two more lifting elements 56, which engage from below on bottom drum 48 of both of the conveyor belts 30. In order to attain continuous operation of the sewing installation, conveyor belts 30 of second material handling device 27 are continuously driven both in raised state and in lowered state by motor 38. The two sewing machines 29 also work continuously. To allow for a continuous pick-up of fabric articles 10, 10' and so forth by second material handling device 27 under these conditions, the two lifting elements 56 are arranged so that they can be moved back and forth parallel to conveyor belts 30. During their movement in the direction of conveyance of fabric articles 10, 10' and so forth, lifting elements 56 are in a raised state (FIGS. 5–7), while during their movement in the opposite direction back into their original position they are in lowered state (FIGS. 1 and 4). Lifting elements 56 are arranged in a mirror image arrangement on the sewing installation and are identical in construction. Therefore only one of them is shown in the drawing.

Lifting mechanism 56 comprises a lifting cylinder 57 which is fastened by its bottom end to a holder 58, which then engages securely on a sliding carriage 59. Sliding carriage 59 is mounted on a guide 60 so that it can be moved back and forth parallel to the direction of material conveyance in second material handling device 27. The back and forth movement of sliding carriage 59 takes place by means of a chain 61 which runs around two rollers 62, of which the left roller 62 as shown in FIGS. 1 and 2 is powered by means of another chain 63 by a motor 64 working in two directions of rotation. A lifting element 65 in the form of a rod is connected with the piston of lifting cylinder 57, and at the top end of element 65 is mounted a universal roller 66. This roller 66 can be introduced through a longitudinal slot 67 in supporting plates 26 and can be brought into engagement with the bottom of bottom drum 48 of conveyor belts 30, when the piston rods of lifting cylinder 57 are extended downward and upward. Longitudinal slots 67 in supporting plates 26 extend over the entire range of movement of lifting elements 56.

A back-up roller 68 for the bottom drum 48 of conveyor belts 30 is provided in front of the roller 66 of lifting mechanism 56 which can be raised and lowered, in the direction of conveyance of fabric articles 10, 10' and so forth. This back-up roller 68 in its particular design is universally rotatably mounted on an arm 69 (FIG. 3), which is fastened to holder 58. These two back-up rollers 68 hold the bottom drums 48 of conveyor belts 30 the same as back-up rollers 47" perpetually in position with fabric articles 10, 10' and so forth on supporting plates 26, whether conveyor belts 30 are raised (FIGS. 5–7) or lowered (FIGS. 1 and 4).

Two scanning elements 70, 71 are fastened to the part of each holder 58 which is bent at an angle, projecting upward over sliding carriages 59, as seen in the direction of material conveyance of fabric articles 10, 10' and so forth, at a certain spacing from each other, and scanning elements 70, 71 can be photocells and can detect the ends and the beginnings of fabric articles 10, 10' and so forth which are following one after the other, in order, in succession, to control the raising and lowering of conveyor belts 30 as well as the raising and lowering and back and forth movement of lifting elements 56.

The operation of the first and second material handling devices 17 and respectively 27 of the sewing installation is as follows:

When the sewing installation is started up, gripping device 13 picks up the uncut piece of fabric 12 at cutting edge 14 and draws a portion of this uncut piece of fabric in the direction of the arrow, to a length corresponding to the length of the fabric article 10, 10' and 10" which is to be provided with a seam or the like. After separation of the fabric article 10 from uncut piece of fabric 12 by cutting blade 15, two entrainment bars 20 are lowered by lifting cylinders 22 and thus are brought into position with the opposite edges of fabric article 10, located on supporting plates 26. Both conveyor belts 30 of second material handling device 27 as well as the two lifting elements 56 are found in raised state in this starting up phase of the installation and fall into the positions shown in FIG. 7. The two conveyor belts 30 are simultaneously driven by motor 38 in the direction of the arrow or respectively the direction of conveyance of fabric articles 10, 10', 10" and so forth and both sewing machines 29 are placed in operation.

Entrainment bars 20 of first material handling device 17 now thrust fabric article 10 on the two supporting plates 26 in the direction of second material handling device 27 and bring edge segments of fabric article 10 found on the two supporting plates 26 under the raised parts of bottom drums 48 of the two conveyor belts 30 as shown in FIG. 7. When the two photocells 70 detect the beginning of fabric article 10, in other words its front moving edge, entrainment bars 20 of first material handling device 17 are raised over a control circuit (not shown) by lifting cylinder 22 (shown in FIG. 3 in dot-dash lines) and are moved by means of corresponding rotation of drive motor 25 back over chain 23 into the original position shown in FIG. 1, in order to pick up a new fabric article 10. Thus it is important that the transport speed of the first material handling device 17 over the major portion of its transport segment be greater than the transport speed of the second material handling device 27. Not until shortly before the time at which the beginning of fabric article 10 is detected by the two photocells 70 is the transport speed of the first material handling device 17 assimilated to that of the second material handling device 27.

Shortly before entrainment bars 20 move upwardly the two lifting cylinders 43, the four lifting cylinders 50 and the two lifting cylinders 57 are actuated by the control circuit (not shown) which is actuated by photocells 70, and lifting cylinders 43 lower sliding carriage 42 and thus also back-up rollers 47. Lifting cylinders 50 lower back-up rollers 47', while lifting cylinders 57 thrust rollers 66 downward into a position beneath supporting plates 26. Conveyor belts 30 are thus brought with their bottom drum 48 into engagement with the edge segments of fabric article 10 located on supporting plates 26 and transport fabric article 10 in the direction of the arrow, in other words in the direction of the two folding devices 28 and sewing machines 29. This state is shown in FIG. 1 in connection with fabric article 10'. As soon as lifting elements 56 or respectively rollers 66 have taken the lowered position shown in FIG. 1, they are moved by motors 64 over chains 61 to the left in FIG. 1 into the original position shown in FIG. 4. Motors 64 are disconnected by the control circuit as soon as lifting elements 56 have taken their original position.

FIG. 4 shows fabric article 10' already moved further for a certain distance by conveyor belts 30 in the direction of the arrow. When the two photocells 71 detect the end or respectively the following edge of fabric article 10' (FIG. 5), then lifting cylinders 43 and 57 are actuated once again, in order to lift sliding carriage 42 and with it a part of bottom drum 48 of conveyor belts 30 as well as rollers 66. This state is shown in FIG. 5. Simultaneously, motors 64 are reconnected by the control circuit, and now rotate in the opposite direction, in order to move sliding carriage 59 over chains 61 with a speed in material conveyance direction of fabric article 10' which corresponds to the running speed of conveyor belts 30. Therefore lifting elements 56 or respectively rollers 66 in raised state are moved together with fabric article 10' in the direction of conveyance, as shown in FIG. 6, whereupon the raised segment of bottom drum 48 of conveyor belts 30 is lengthened continuously in the direction of conveyance of fabric article 10'.

During the passage of holder 58 for rollers 68 and photocells 70, 71, fastened to sliding carriage 59, electric limit switches 52 are operated one after the other in order to actuate lifting cylinders 50, which move back-up rollers 47' upward into the positions shown in FIGS. 6 and 7. During the raising of sliding carriage 42, back-up rollers 47 have already been brought into their raised position. In this work phase of second material handling device 27, entrainment bars 20 of first material handling device 17 are already moving another fabric article 10 along supporting plates 26 under the raised bottom drums 48 of the two conveyor belts 30, as shown in FIG. 6. When fabric article 10 has reached the position shown in FIG. 7, photocells 70 detect the beginning or respectively the front edge of fabric article 10, and the result is that lifting cylinders 43, 50 and 57 are actuated so as to move sliding carriage 42 including back-up rollers 47, back-up rollers 47' and roller 66 downward into the positions shown in FIG. 1. Shortly thereafter entrainment bars 20 of first material handling device 17 are raised again and carried back. The material handling cycle indicated in FIG. 1 is now repeated with fabric article 10', as explained above.

FIGS. 5, 6 and 7 show, and it has already been explained, how lifting elements 56 are moved in the direction of the arrow together with fabric article 10 toward sewing machines 29. The work speed of sewing machines 29 is adapted to the running speed of conveyor belts 30 of second material handling device 27. The above explanation indicates that the sewing installation works continuously, and the transfer of fabric articles 10, 10', 10'' and so forth from first material handling device 17 to second material handling device 27 occurs in "flying exchange" with continuously revolving conveyor belts 30 and perpetually working sewing machines 29.

The exemplary embodiment is described relative to fabric articles 10, 10', 10'' and so forth, which are provided with seams on two opposite edges and are sewn up. The same process can also occur along the remaining two edges. If rubber strips, bindings, trimming, braid or the like are to be sewn on these edges of fabric articles 10, then suitable feed devices for these elements are required, which are known and therefore need no further description.

What is claimed is:

1. Sewing installation for fabric articles, comprising a first material handling means for the fabric articles drawn from a stockpile, which transfers the fabric articles to a second material handling means having endless conveyor belts with bottom drums, a lifting means for raising the conveyor belts for an introduction of the fabric articles over a portion of their length and for lowering the conveyor belts for a pick-up and further conveyance of the fabric articles to at least one sewing machine, the lifting device having movable lifting elements which have means to engage from below in turn on the bottom drums of the conveyor belts, the improvement wherein:

(a) the lifting elements (56) have means to be driven back and forth substantially parallel to the conveyor belts (30) of the second material handling means (27), and can be driven in a direction of conveyance in a raised state and in an opposite direction in a lowered state, (b) the raising and lowering movement of the conveyor belts (30) of the second material handling means (27) as well as the raising and lowering movement and the back and forth movement of the lifting elements (56) are controlled by means of following scanning elements (70, 71), which detect ends and beginnings of fabric articles (10) which are in series one following another, and (c) the conveyor belts (30) of the second material handling means (27) have means to circulate continuously in the raised and lowered state.

2. Sewing installation as in claim 1, comprising means for controlling a speed of the conveyance of the material in the first material handling means (17) so that the speed of conveyance is higher over a major portion of its material handling segment than a speed of the second material handling means (27) and so that not until shortly before the lowering of the second material handling means (27) for the purpose of picking up a fabric article (10), is the speed of the second material handling means (27) assimilated with that of the first material handling means (17).

3. Sewing installation as in claim 1, wherein the lifting elements (56) arranged in the direction of conveyance of the second material handling means (27) have means to be driven synchronously at its speed of conveyance, which is adapted to a work speed of the sewing machines (29).

4. Sewing installation as in claim 1, with a plurality of back-up rollers engaging on the bottom drum of the conveyor belts of the second material handling means, which rollers have means to be raised with the conveyor belts and in lowered position hold the conveyor belts against the fabric articles found on supporting plates of the sewing installation, wherein the back-up rollers (47') can be raised in a range of movement of the lifting elements (56) when said elements (56) are brought into vicinity of one another during movement in the direction of the conveyance.

5. Sewing installation as in claim 1, wherein each lifting device has a lifting member (65), mounted to be vertically movable, having a roller (66) on a sliding carriage (59) which is operable by means of a lifting cylinder (57), and said roller (66) can be brought into engagement with the bottom of the bottom drum (48) of said conveyor belt (30) of the second material handling device (27), and the sliding carriage (59) is mounted to be able to be moved back and forth on a guide (60) which is arranged parallel to the direction of the conveyance of the second material handling device (27).

6. Sewing installation as in claim 5, wherein the sliding carriage (59) seen in the direction of conveyance of the fabric article (10) in front of the roller (66) has means to be raised and lowered supports a back-up roller (68) for the bottom (48) of said conveyor belt (30) of the second material handling means (27).

7. Sewing installation as in claim 6, wherein a holder (58) which projects upwardly from the sliding carriage (59) is provided for the scanning elements (70, 71) controlling the lifting means (43, 50, 57).

8. Sewing installation as in claim 5, wherein a holder (58) which projects upwardly from the sliding carriage (59) is provided for the scanning elements (70, 71) controlling the lifting means (43, 50, 57).

* * * * *